US005501287A

United States Patent [19]

Loeser

[11] Patent Number: 5,501,287

[45] Date of Patent: Mar. 26, 1996

[54] DRILLING DEVICE WITH TELESCOPIC KELLYBAR

[75] Inventor: Gottfried Loeser, Olpe-Rhode, Germany

[73] Assignee: Ing. G. Klemm Bohrtechnik GmbH, Germany

[21] Appl. No.: 302,316

[22] Filed: Sep. 8, 1994

[30] Foreign Application Priority Data

Sep. 29, 1993 [DE] Germany ..... 43 33 114.9

[51] Int. Cl.[6] ..... E21B 4/02

[52] U.S. Cl. ..... 175/173; 175/203; 175/220

[58] Field of Search ..... 175/122, 162, 175/173, 203, 220

[56] References Cited

U.S. PATENT DOCUMENTS

| | | | |
|---|---|---|---|
| 1,726,565 | 9/1929 | Hunt | 175/173 X |
| 1,855,999 | 4/1932 | Shinn | 175/203 X |
| 1,895,901 | 1/1933 | Smith | 175/203 |
| 2,781,185 | 2/1957 | Robbins | 175/220 X |
| 3,131,776 | 5/1964 | Kvello-Aune et al. | 175/162 X |
| 3,565,190 | 2/1971 | Ishii | 175/173 X |

*Primary Examiner*—Roger J. Schoeppel
*Attorney, Agent, or Firm*—Diller, Ramik & Wight

[57] ABSTRACT

The drilling device includes a telescopable Kellybar (16) with an outer tube (17) and at least one telescope tube (18). A tool (22) is mounted to the lower end of the telescope tube (18). In order to supply pressure medium to the drilling tool (22), the telescope tube (18) includes an inner tube (25) which is connected to a pressure line (33) via a rotating head (30). In order to secure the stator of the rotating head against rotation, a rotation protecting means (36) is provided which projects into the outer tube (17). Without exchanging the drilling mast, the drilling device can be used for drill hole depths greater than the length of the drilling mast (10); nevertheless, it can be used with pressure fluid as flushing agent or driving agent for a tool.

10 Claims, 3 Drawing Sheets

Figure 1:
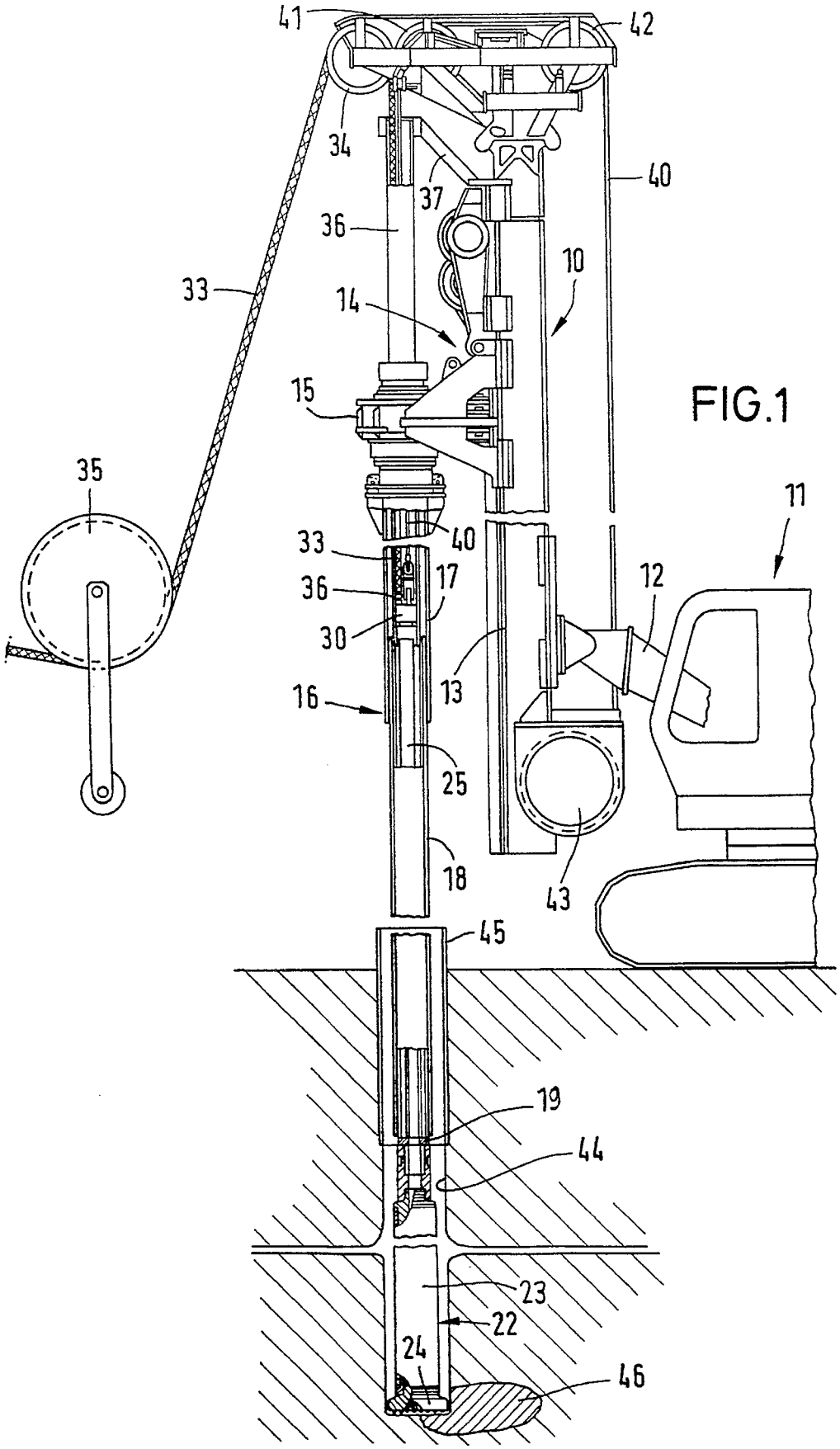

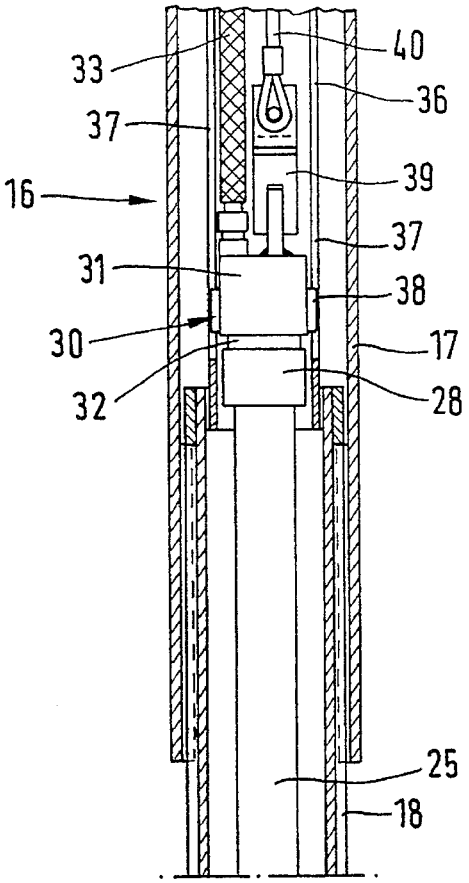
FIG. 2
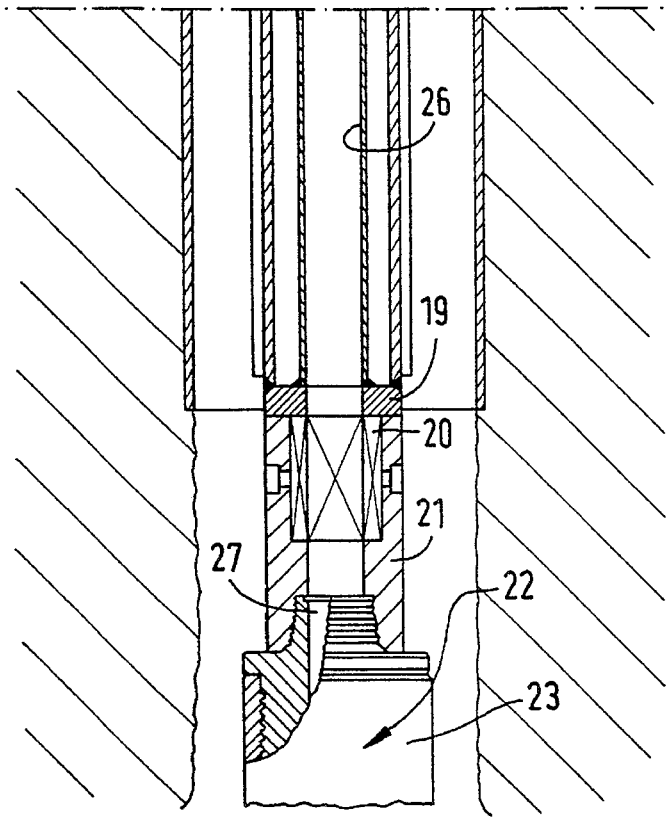

DRILLING DEVICE WITH TELESCOPIC KELLYBAR

BACKGROUND OF THE INVENTION

The invention relates to a Kellybar drilling device which is particularly suitable for pile drillings.

For making foundation bores for piles, Kellybars are used which are telescopable to reach drilling depths greater than the drilling mast length without the use of extension segments. The Kellybar consists of an outer tube and at least one telescopic tube arranged therein and being displaceable thereout, which is lockable to the outer tube to transfer the torque required for drilling and the axial thrust forces to the drilling tool. The drilling tools which are typically used and mounted to the front end of the innermost telescope tube are rotary drilling tools (augers, drill buckets, core drilling auger bits) which receive the earth in the drill hole. When the rotary drilling tool is filled with earth, the Kelly system is drawn up with a rope, the tubes of the Kellybar telescoping into each other.

Primarily, the conventional Kellybar systems with rotary drilling tools can only be applied in non-rocky ground, but fail when there are pieces of rock or similar hindrances in the ground which cannot be overcome by dry rotary drilling. A pressure medium like compressed air or liquid cannot be fed to the tool through a Kellybar because the pressure medium would escape at the connection spots of the tubes of the Kellybar. For the same reason, it is not possible to perform flush drillings in which case a flushing agent is introduced into the drilling hole to flush out the drilling stock.

SUMMARY OF THE INVENTION

It is the object of the present invention to provide a drilling device with a telescopable Kellybar by means of which greater drilling obstacles can be overcome and which permits rotary percussion drilling or flush drilling.

With the drilling device according to the invention, a pressure fluid is not directly introduced into the interior of the Kellybar, but into a pressure line extending into the Kellybar. This pressure line is connected to a rotating head comprising a non-rotating stator and a rotor connected for co-rotation to the innermost telescope tube of the Kellybar. The stator of the rotating head is retained by a fixing device, so that the pressure line does not rotate or is not wound up upon rotation of the Kellybar. Thus, the pressure line is connected to the innermost telescope tube by utilizing a rotating head included in the Kellybar. Thereby, it is possible to bring the pressure medium near the tool. The tool, for example, may include an in-hole hammer which is supplied with the supplied pressure medium and exerts impacts onto a drill bit. The tool may also include a flushing means out of which the pressure medium emerges in order to flush drill stock out of the drill hole.

By means of the invention, it is possible to operate a Kellybar drilling device additionally with a pressure medium which has so far not been possible owing to the sealing problems of the telescopable Kellybar.

Figure 3:
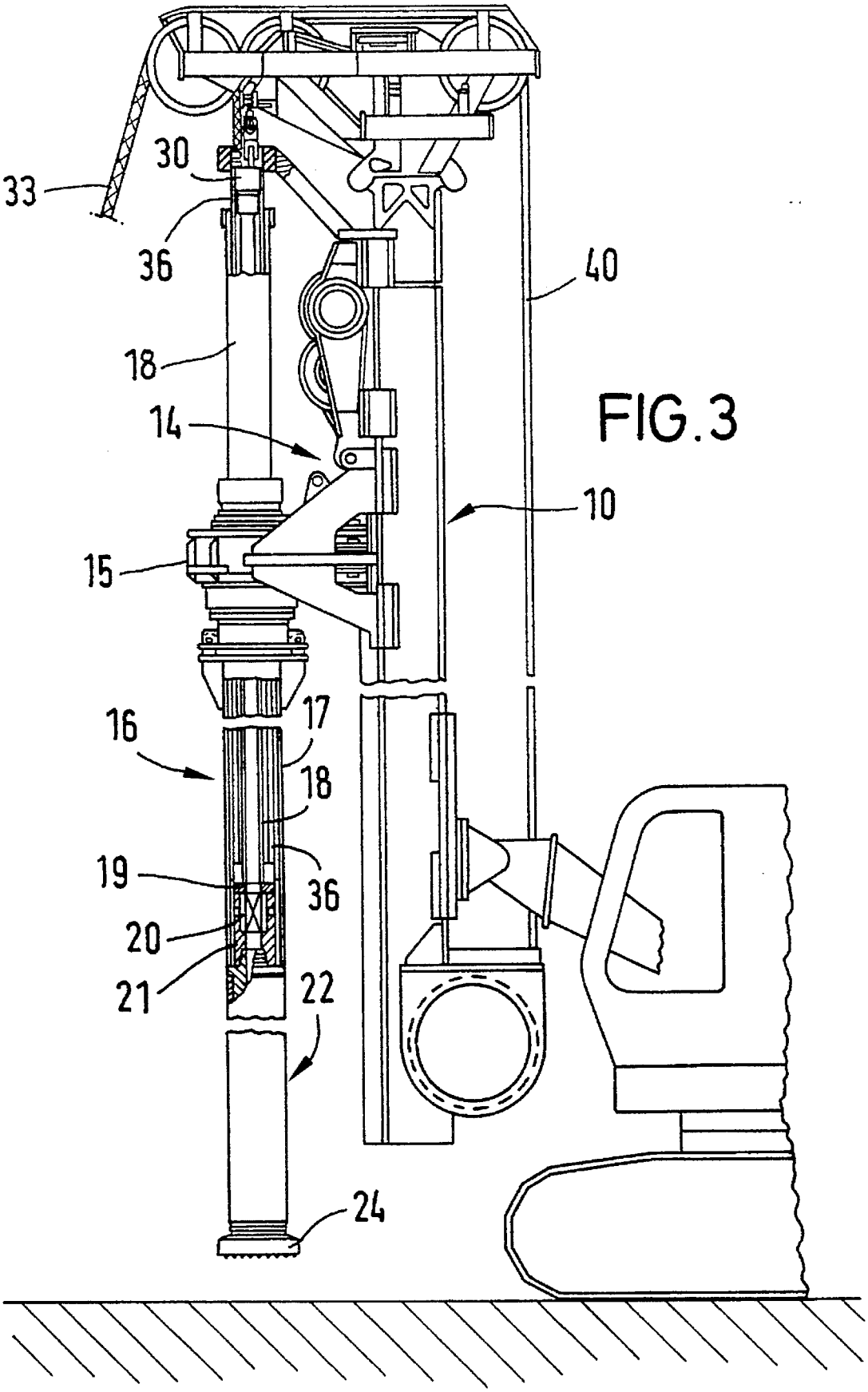

Hereinafter, an embodiment of the invention is explained in detail with reference to the accompanying drawings, in which:

FIG. 1 is a side view of the drilling device, partially in cross section, during the drilling operation, FIG. 2 is an illustration of details of FIG. 1 on enlarged scale, and FIG. 3 shows the drilling device in drawn-up condition.

The drilling device comprises a drilling mast 10 which is fastened at the cantilever 12 of a vehicle 11 and can be placed vertically. On a longitudinal guide 13 of the drilling mast, a carriage 14 is vertically displaceable. The carriage 14 carries a drive head 15 for the telescopable Kellybar 16.

The Kellybar 16 comprises an outer tube 17 and, in this case, a single telescope tube 18 being telescopically displaceable within the outer tube. Both tubes 17 and 18 may be of generally the same length. By means of splines or the like, they are secured against rotation with respect to each other. Further, the telescope tube 18, when in its fully extended position, is locked against axial displacement relative to the outer tube 17 upon rotation of the Kellybar in the one rotational direction. This locking can be released when the Kellybar is rotated in the other rotational direction so that the tubes 17 and 18 can then be telescoped into each other.

The front end of the telescope tube 18 is closed by a bottom plate 19 welded thereto and comprising an axially projecting extension piece 20. The drilling tool 22 is mounted to this extension piece 20 by means of an adapter 21. In the illustrated embodiment, the drilling tool 22 consists of an in-hole hammer 23 and a drill bit 24.

A tube 25 forming a channel 26 extends through the telescope tube 18 over the entire length thereof. The lower end of the tube 25 is welded to the bottom plate 19 and the channel 26 communicates with the inlet 27 of the in-hole hammer 23 via the hollow extension piece 20.

A connection collar 28 projecting slightly beyond the upper end of the telescope tube 18 is arranged at the upper end of the tube 25.

The tube 25 is connected to the rotating head 30 consisting of a stator 31 and a rotor 32. The connection collar 28 is sealingly connected to the stator 31. A flexible pressure line 33 passing through the rotating head 15 and traveling over guide rolls 34,35 leads to the stator 31. By means of a flexible tensioning means (not shown), the pressure line 33 is maintained in a tense state. The pressure fluid supplied by the pressure line 33 to the rotating head 30 is transferred into the tube 25 and passed on to the tool 22 thereby.

While the tube 25 is rotating together with the Kellybar 16, the stator 31 of the rotating head 30 is secured against rotation by means of a rotation protecting means 36. The rotation protecting means 36 is a tube being mounted to the carriage 14 by a holding device 37 and projecting through the drive head 15 into the outer tube 17 of the Kellybar 16. This tube has strips or slots 37 engaging with projections 38 of the stator 31 so that the rotating head 30 can be axially moved in the rotation protecting means 36, but is secured against rotation.

In addition, a holding means 39 for a traction rope 40 is arranged at the stator 31. This traction rope extends through the tube 36 over guide rolls 41,42 provided at the upper end of the drilling mast 10 to a rope winch 43 which can be driven to draw up the telescope tube 18 together with the tool 22.

In the illustrated embodiment, the upper end of the drill hole 44 is secured by a supporting tube 45 which can be pushed after into the drill hole in correspondence with the drill progress to support the drill hole wall. Supporting the drill hole wall may be advantageous in order to prevent fluid flushed back in the drill hole from flushing out the drill hole.

The drilling device operates as follows:

First, it is operated with the Kellybar 16 retracted according to FIG. 3, the telescope tube 18 being completely retracted in the outer tube 17. At this time, the tube 36 is located between the tubes 17 and 18. In this position, the tubes 17 and 18 are locked relative to each other against axial displacement. The drive head 15 engages the outer tube 17 at the outside thereof and rotates it, the telescope tube 18 and the tool 22 being rotated thereby. The carriage 14 is moved downwardly along the drilling mast 10 and thereby rotatingly advances the Kellybar 16 by the drive head 15. When the carriage 14 has moved to the lower end of the drilling mast 10, the rope 40 is wound off by actuating a rope winch. Thereby, the telescope tube 18 can be drawn out of the outer tube 17 corresponding to the lowering speed dependent on the advance of the tool.

The drilling operation can also be performed as flush drilling. In this case, a flushing agent (air or liquid) is supplied through the pressure line 33. This flushing agent arrives at the drilling tool 22 through the rotating head 30 and the tube 25. It emerges at the drill bit 24 and flushes up the drill stock in the drill hole 44.

Furthermore, it is possible to perform a percussive drilling operation by actuating the in-hole hammer 22. The in-hole hammer is driven by the medium supplied under pressure to exert impacts onto the drill bit 24. Thereby, rocks 46 can be shattered.

Instead of the drilling tool 22 shown in the drawings, other drilling tools which use a pressure or flushing medium can be used as well.

In the embodiment described, the rotation protecting means 36 is fastened to the carriage 14 and has a constant length. Alternatively, there also exists the possibility to configure the rotation protecting means so as to be telescopable, so that it adapts to the extension length of the telescope tube 18 or follows the telescope tube, respectively. In this case, the rotation protecting means may be fastened to the drilling mast 10.

I claim:

1. A drilling device comprising a telescopic Kellybar (16) including an outer tube (17) and at least one inner telescopic tube (18) guided and lockable in said outer tube (17), a tool (22) being mountable to a front end of the inner telescopic tube (18), a drilling mast (10) on which a carriage (14) is displaceable, said carriage (14) including a drive head (15) for rotating the outer tube (17) of the Kellybar (16), a rotating head (30) being provided in the Kellybar (16), said rotating head (30) including a stator (31) connected to at least one pressure line (33) and a rotor (32) connected to the front end of the inner telescopic tube (18), and a rotation protecting means (36) projecting into the outer tube (17) extending to the stator (31) for preventing rotation of the stator (31) with the Kellybar (16).

2. The drilling device according to claim 1 including traction element means (40) for engaging the rotating head (30) for pulling up the inner telescopic tube (18) of the Kellybar (16).

3. The drilling device according to claim 1 wherein the rotation protecting means (36) includes a tube passing through the drive head (15) and behind held against rotation above the drive head.

4. The drilling device according to claim 3 wherein the at least one pressure line (33) is a flexible hose line passed over a roll (34) supported on the drilling mast (10) and is resiliently biased in its longitudinal direction.

5. The drilling device according to claim 1 wherein the rotor (32) of the rotating head (30) is connected to at least one channel (26) extending through the inner telescopic tube (18) to a lower end thereof.

6. The drilling device according to claim 5 wherein the at least one channel (26) extends in a tube (25) connected at the lower end of the tube (18) to a bottom plate (19) closing inner telescopic tube (18).

7. The drilling device according to claim 6 wherein the bottom plate (19) includes a projecting transition piece (20) for mounting a tool (22), and the transition piece (20) having at least one bore for supplying a pressure medium to the tool (22).

8. The drilling device according to claim 1 wherein the rotation protecting means (36) is a telescopic tube.

9. The drilling device according to claim 1 wherein the rotation protecting means (36) is a rigid tube, and the stator (31) of the rotating head (30) slides along the rotation protecting means (36).

10. The drilling device according to claim 1 wherein said inner telescopic tube (18) includes a channel (26) to an upper end of which the rotor (32) is mounted.

* * * * *